US007297079B1

(12) United States Patent
Delauter

(10) Patent No.: US 7,297,079 B1
(45) Date of Patent: Nov. 20, 2007

(54) GAME SYSTEM

(76) Inventor: Keith H. Delauter, 10257 Meadowridge Dr., Myersville, MD (US) 21773

( * ) Notice: Subject to any disclaimer, the term of this patent is extended or adjusted under 35 U.S.C. 154(b) by 0 days.

(21) Appl. No.: 11/635,491

(22) Filed: Dec. 8, 2006

(51) Int. Cl.
*A63F 67/00* (2006.01)

(52) U.S. Cl. ..... 473/473; 273/349; 273/459

(58) Field of Classification Search ..... 273/349, 273/459; 473/473, 490, 492
See application file for complete search history.

(56) References Cited

U.S. PATENT DOCUMENTS

| | | | | |
|---|---|---|---|---|
| 906,848 | A | 12/1908 | Atwell | |
| 1,300,972 | A | 4/1919 | Janssen | |
| 3,866,916 | A * | 2/1975 | Clarke | 273/338 |
| 4,573,679 | A * | 3/1986 | Janszen | 473/427 |
| 4,595,155 | A | 6/1986 | Gough | |
| 4,993,719 | A | 2/1991 | Hernandez | |
| 5,279,151 | A | 1/1994 | Coody et al. | |
| 5,303,932 | A * | 4/1994 | Kessler | 473/492 |
| 5,338,044 | A * | 8/1994 | Mazursky et al. | 273/402 |
| 5,375,849 | A * | 12/1994 | Sabourin | 473/466 |
| 5,462,284 | A * | 10/1995 | Felsenthal | 473/473 |
| 5,586,767 | A * | 12/1996 | Bohland | 273/349 |
| 5,611,539 | A | 3/1997 | Watterson et al. | |
| 6,807,999 | B1 | 10/2004 | Bowen et al. | |

* cited by examiner

*Primary Examiner*—Raleigh W. Chiu
(74) *Attorney, Agent, or Firm*—Stephen R. Greiner

(57) ABSTRACT

An outdoor game system includes a pole adapted for anchoring to the earth. A water-carrying conduit extends upwardly through the pole and is rotatable within the pole. A sprinkler is mounted atop the pole and is connected to the conduit. A reel is affixed to the conduit within the pole adjacent an opening in the pole. The reel is rotatable with the conduit. A net, capable of extension from the opening in the pole, is wound upon the reel. An elongated cover is provided for closing the opening in the pole. The cover is connected to the net for supporting the net above the earth, when the net is extended from the opening in the pole. A handgrip, for rotating the conduit to rewind the net upon the reel, is affixed to the conduit beneath the reel.

2 Claims, 3 Drawing Sheets

10
12
14
16
20
22
24
26
28
30
32
34
36
38
40
42
44
48
50
52
54
56
58
60
62
64
66
68
70
72
74
76
78
80
82
86
90
94
96
102
104
106

GAME SYSTEM

FIELD OF THE INVENTION

The present invention relates generally to amusement devices and, more particularly, to court games and accessories therefor.

BACKGROUND OF THE INVENTION

For generations, kids have played volleyball and tetherball outdoors. To avoid interference from trees and houses, volleyball and tetherball courts were, and still are, set up in open, grassy areas. These areas, lacking significant shade, however, often prove too hot for extended periods of playing outdoor games, especially during summer months. Volleyball and tetherball games, then, are often short, being broken up by dips in a nearby pool or by play with a garden hose.

SUMMARY OF THE INVENTION

Since staying cool while playing volleyball and tetherball outdoors is often difficult, it is a principal object of the invention to provide a single game system that allows users to play games of either volleyball or tetherball and that sprinkles water on users as either game progresses. The sprinkling, coming from above the users, does not impede game play.

It is another object of the invention to provide a game system of the type described that can be converted from a volleyball game to a tetherball game, and vise versa, in a matter of seconds and without the use of tools and without the need for prolonged training to accomplish the conversion.

It is an object of the invention to provide improved features and arrangements thereof in a game system for the purposes described that is lightweight in construction, inexpensive to manufacture, and dependable in use.

Briefly, the game system in accordance with this invention achieves the intended objects by featuring a pole anchored to the earth. A rotatable, water-carrying conduit extends upwardly through the pole. A sprinkler is mounted atop the pole and is connected to the conduit. A reel is affixed to the conduit and is rotatable with the conduit. A net, capable of extension from an opening in the pole, is wound upon the reel. An elongated cover closes the opening in the pole and is connected to the net so as to support the net when the net is extended from the opening in the pole. A handgrip is affixed to the conduit for rotating the conduit to selectively rewind the net upon the reel. Also, a tetherball is secured by means of a tether to the top of the pole.

The foregoing and other objects, features, and advantages of the game system will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
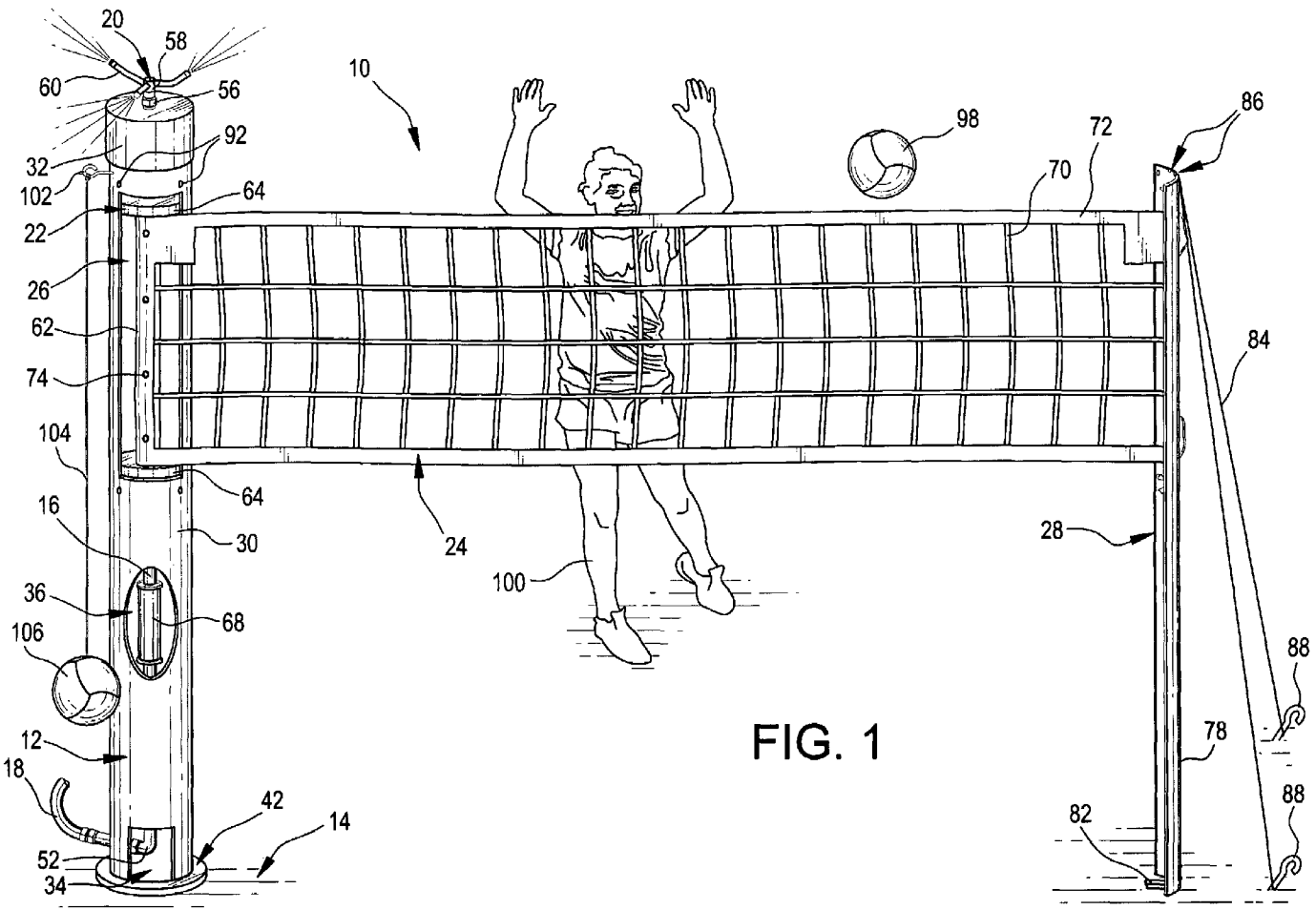
FIG. 1 is a perspective view of a game system in accordance with the present invention with the net thereof being fully extended for tetherball game play.

Referring now to the FIGS., a game system in accordance with the present invention is shown at 10. Game system 10 includes a pole 12 adapted for anchoring at its bottom to the earth 14. Extending upwardly through pole 12 is a conduit 16 for conveying water from a garden hose 18 to a sprinkler 20 mounted atop pole 12. A reel 22 is affixed to the top of conduit 16 within pole 12. Wound upon reel 22 is a net 24 that can be selectively extended from pole 12. The opening 26 in pole 12 from which net 24 is extended is closed by an elongated cover 28 that also serves as a support for net 24 during the playing of volleyball games.

Pole 12 includes a hollow tube 30 upon the top of which is fitted a cap 32. Tube 30 measures about 12 feet (3.66 m) in length and 1 foot (30.4 cm) in diameter. The side wall of tube 30 has a thickness of about 0.25 inches (0.64 cm) and has access openings 26, 34, 36, respectively located at the top, bottom, and middle thereof. Cap 32, however, has a circular, top plate 38 adhesively fastened to the top of tube 30. From the periphery of top plate 38, a tubular retaining wall 40 extends downwardly to snugly engage and reinforce tube 30. Tube 30 and cap 32 are made from PVC, known for its light weight, great strength, durability, and water resistance, but can be formed from, and fastened together by, other suitable materials.

The bottom of pole 30 is slidably fitted within a ground anchor 42. As shown, anchor 42 has a tubular sleeve 44 vertically affixed by a mass of cement 46 to earth 14. The top of sleeve 44 is provided with an outwardly extending, peripheral lip 48 that sits atop cement 46 for reinforcing sleeve 44 and keeping soil out of sleeve 44. Sleeve 44 measures about: 2 feet (61 cm) in length, 1 foot (30.4 cm) in diameter, and 0.25 inch (0.64 cm) in wall thickness.

Although the most common sites for tetherball or volleyball courts are on a lawn, heavy use can make such an area muddy. Fortunately, cover 28 can be variably positioned around anchor 42 to reduce wear and tear on sod. Alternatively, extra driveway space can provide a good site for the positioning of anchor 42, as can a graveled or mulched area, all of which make it somewhat easier to play games while the ground is wet. Falling should be rare for most players, so a hard surface should be reasonably safe.

For tetherball play, it is best to have about 10 feet (3.04 m) of clear, level ground around anchor 42. The only boundary needed is a line (not shown) radiating out from anchor 42 dividing the play area into two equal halves. Such a line can be provided in any suitable manner.

Volleyball play requires more space than tetherball play. A typical volleyball court measures 29.5 feet by 59 feet (18 m×9 m). Such a court is positioned so that anchor 42 is placed along one side of the court so as to divide the side in half. For play, cover 28 is extended to an opposing point on the other side of the court and is affixed there. The boundaries of the court can be delineated upon the earth in any suitable manner.

Conduit 16 extends longitudinally through pole 12. The top of conduit 16 passes rotatably through an opening 50 in top plate 38. The bottom of conduit 16 is positioned adjacent opening 34 in tube 30. Conduit 16 measures about 11 feet (3.35 m) in length and has an outer diameter of about 1 inch (2.5 cm) and an inner diameter of about 0.75 inches (1.9 cm).

An L-shaped hose fitting 52 is connected to the bottom of conduit 16. Fitting 52 provides for the threaded fastening of garden hose 18 to conduit 16. So that hose 18 does not become tangled when conduit 16 is rotated to extend or retract net 24, as will be explained more fully below, a swiveling pipe joint 54 is positioned between conduit 16 and fitting 52. Thus, fitting 52 can always be extended from tube 30 regardless of the angular orientation of conduit 16.

Sprinkler 20 includes a base 56 that carries a rotatable hub 58. As shown, base 56 is affixed to the top of conduit 16 so as to receive water therefrom and to hang conduit 16 from top plate 38 of cap 32. Base 56 serves as a vertical axle upon which hub 58 rotates. A number of jetting arms 60 radiate outwardly from hub 58. Arms 60 are hollow and their inner ends are in fluid communication with the interior of hub 58 and their outer ends are open so as to serve as spray nozzles. When water from a pressurized source, like hose 18, is delivered to sprinkler 20 via conduit 16, arms 60 jet water tangentially to hub 58 thereby causing hub 58 and arms 60 to rotate and spray water in all directions around pole 12 to the amusement of game players.

Reel 22 has a cylindrical core 62 with a pair of outwardly extending peripheral flanges 64 being respectively located at the top and bottom of core 62. Core 62 is provided with an interior passageway (not shown) sized to snugly receive conduit 16. Snap fasteners as at 66 are provided on the exterior of core 62 for the releasable attachment of net 24 to reel 22. Flanges 64 ensure that net 24 is neatly wound upon core 62 and that conduit 16 remains centralized within tube 30 when conduit 16 is rotated for net winding purposes.

The rotation of conduit 16 is manually accomplished. To facilitate rotation, a handgrip 68 is affixed to conduit 16 beneath reel 22 and adjacent opening 36 in tube 30. Rotating handgrip 68 by hand causes conduit 16, sprinkler 20, and reel 22 to rotate about a vertical axis. Continued rotation of reel 22 draws net 24 onto core 62 of reel 22 for the storage of net 24 out of the weather and within pole 12 when it is not in use. Withdrawal of net 24 from pole 12 is accomplished merely by pulling cover 28 away from pole 12, no manipulation of handgrip 68 is required.

Net 24 is conventional in size being about 31 feet (9.50 m) in length, 3.3 feet (1 m) in height, and is made from a rope mesh 70 with openings of about 3.9 inches (10 cm) square. The periphery of mesh 70 is reinforced with a webbing border 72. The inner end of border 72 is provided with snap fasteners 74 adapted for releasable attachment to snap fasteners 66 affixed to reel 22. The outer end of border 72 is provided with grommets 76 for tying net 24 to the top of cover 28. The height of net 24 is about 8 feet (2.4 m) for tetherball game play.

Figures 5, 6, 7:
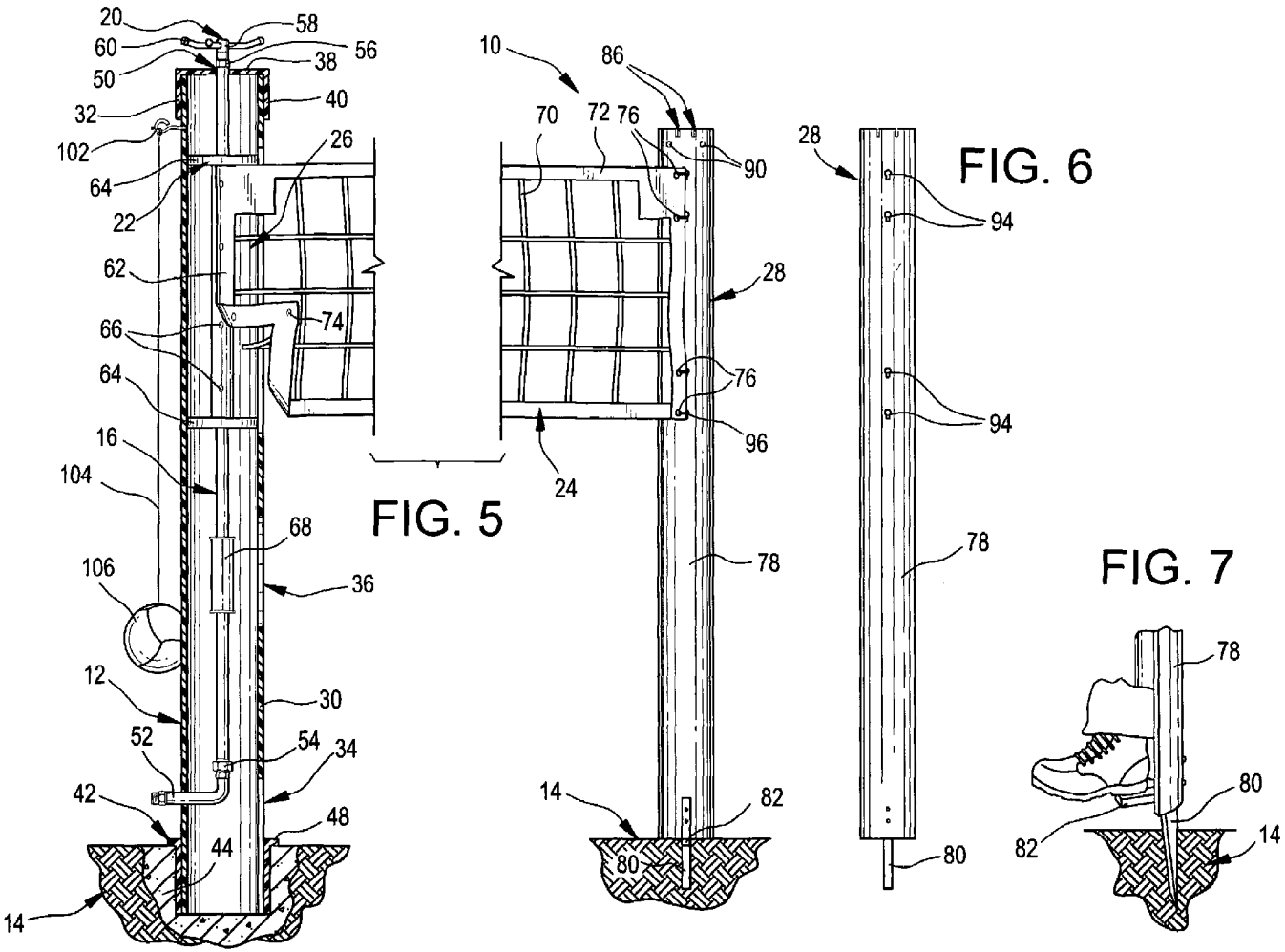
FIG. 5 is a cross-sectional view of the game system with the net being extended and portions thereof being broken away.
FIG. 6 is a front view of the pole cover of the game system that alternately serves as a net support.
FIG. 7 is a perspective view of the bottom portion of the pole cover showing the foothold feature.

Cover 28 includes an elongated bar 78 having a ground-penetrating spike 80 affixed to the bottom thereof. Bar 78, formed of PVC, measures about 10 feet (3.04 m) in length and has a C-shaped cross section to nest snugly against pole 12. Spike 80 is formed of metal and is sharpened so that it can be easily pushed into earth 14. A foothold 82 extends outwardly from the top of spike 80 for the easy application of downward force to spike 80 as illustrated in FIG. 7.

A pair of pins 90 is affixed to the top of bar 78 for holding cover 28 against tube 30 when net 24 is being stored within pole 12. Pins 90 fit snugly within a correspondingly positioned pair of holes 92 in the top of tube 30. A light push or pull is all that is required to insert pins 90 into, or withdraw pins 90 from, holes 92.

Beneath pins 90, openings 94 are provided in the top of bar 78 for the passage of ties as at 96. Ties 96 extend through openings 94 and grommets 76 to attach net 24 to cover 28. Ties 96 can be formed of rope, wire, nylon, or other suitable material.

Figure 4:
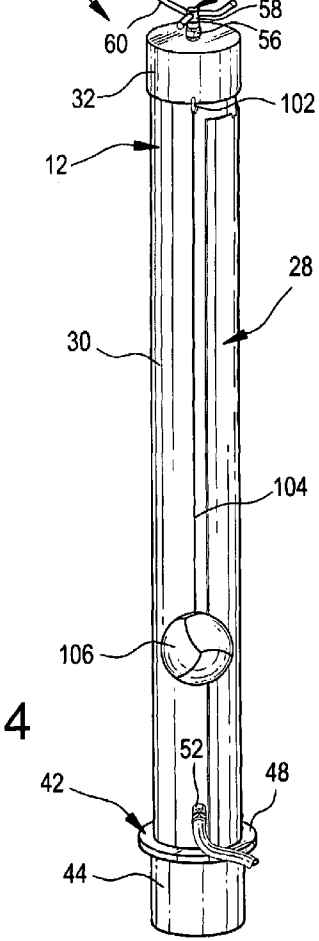
FIG. 4 is a perspective view of the game system with the net retracted and the ground anchor being revealed.
Figure 3:
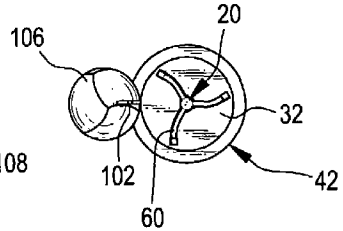
FIG. 3 is a top view of the game system with the net retracted.
Figure 2:
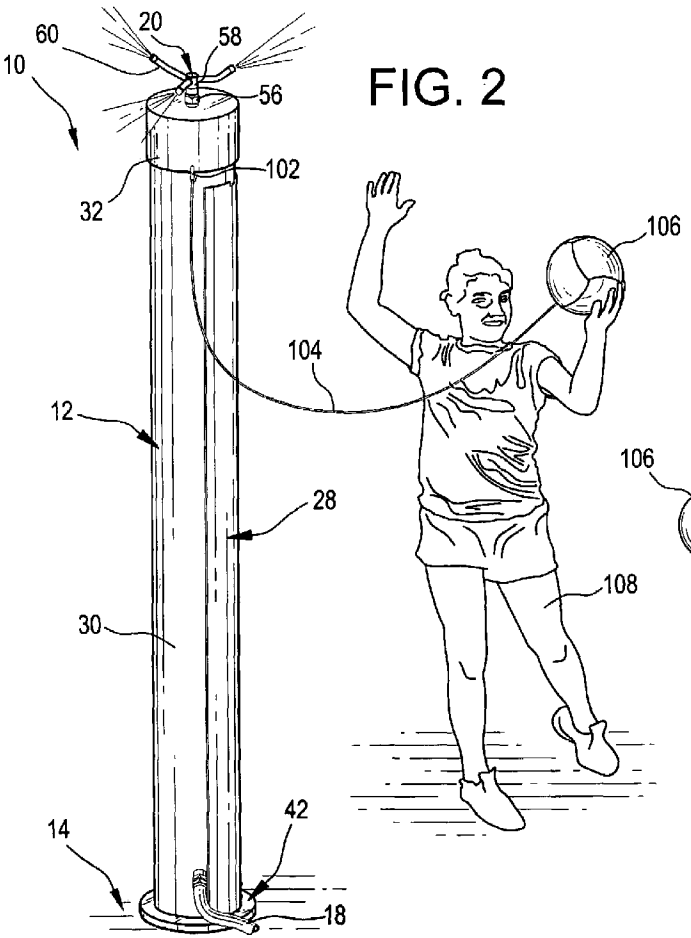
FIG. 2 is a perspective view of the game system of FIG. 1 with the net being retracted into the pole for tetherball game play

When cover 28 is positioned against tube 30 as shown in FIGS. 2-4, spike 80 and foothold 82 are positioned within opening 34. Spike 80 extends downwardly into ground anchor 42 and prevents the bottom of cover 28 from being pulled away from tube 30. Foothold 82, being relatively short does not contact hose fitting 52 found adjacent opening 34 and does not impede in any way the flow of water through conduit 16.

When it is desired that game system 10 be employed for volleyball play, cover 28 is moved away from pole 12 and secured with spike 80 to earth 14 at a desired location. To ensure that cover 28 not tip over, the center portion of a guide rope 84, measuring perhaps 24 feet (7.3 m) in length, can be looped through a pair of slots 86 at the top of bar 78. Then, the opposite ends of rope 84 are pulled taught and fastened to earth by pegs 88.

Volleyball is played in a traditional manner with system 10. Game play proceeds with a ball 98 being first served, and later volleyed, over net 24 by players 100 formed into teams of four to six players on opposite sides of net 24. The serving team scores a point when the receiving team fails to return the ball over net 24 in three or fewer attempts. The serve is lost, however, if the serving team misses a volley in three attempts. A volleyball game is played to twenty-one points.

Each team rotates when it wins the serve so that all players 100 get a turn playing adjacent net 24. Ball 98 can be played off net 24 during a volley. A player 100 cannot hit ball 100 twice in succession nor can he: carry, palm or throw ball 98. Hitting ball 98 toward sprinkler 20 so that water jetted therefrom diverts ball 98 from its original path is encouraged. Not only can water being sprayed from sprinkler 20 keep players 100 cool, but can add a new, strategic aspect to the game of volleyball.

System 10 can be employed for tetherball game play. To this end, an eyebolt 102 is affixed to the top of tube 30. A flexible cord or tether 104 is tied at its inner end to eyebolt 102. A tetherball 106 is tied to the outer end of tether 104. The length of tether 104 is set at 8 feet (2.4 m) so that the bottom of ball 106 ends up about 2 feet (61 cm) above earth 14 when tether 104 is not wrapped around pole 12 and ball 106 is at rest.

A tetherball game is won when one of a pair of players 108 has wrapped tether 104 as far as it can go around pole 12. The usual game begins with one player 108 serving in a direction she chooses, after which either player can hit ball 106. Under the best rules, the serving player 108 must wait until either the other player strikes ball 106, or tether 104 has wrapped four times, before she can strike ball 106 again.

During a game of tetherball, a player 108 cannot: 1) step off sides, 2) touch tether 104, 3) carry or throw ball 106, and 4) double hit ball 106. If either player 108 commits one of these minor rules violations, ball 106 is stopped and returned to the place it was wrapped when the violation occurred. The other player 108 gets to serve, and either player can hit ball

106 from that point on. If a player 108 commits three of the minor violations listed above, in any combination, his opponent wins the game. If a player 108 commits a major rules violation, i.e., grabs pole 12, he automatically loses the game.

Water sprayed from sprinkler 20 can affect tetherball game play and the outcome of a game. For example, hitting ball 106 so that its movement coincides with that of the sprayed water, clockwise or counterclockwise around pole 12, receives a small benefit. The benefit is taken away, however, by an opponent who lofts ball 106 upwardly so as to cause the first player to look directly into the spray to make a hit—an added difficulty. Thus, the use of sprinkler 20 adds another dimension to the game of tetherball.

While game system 10 has been described with a high degree of particularity, it will be appreciated by those skilled in the art that modifications can be made to it. Therefore, it is to be understood that the present invention is not limited merely to game system 10 described above, but encompasses any and all game systems within the scope of the following claims.

I claim:

1. A game system, comprising:

a hollow pole being adapted for anchoring at the bottom thereof to the earth, said pole having an opening therein;

a water-carrying conduit extending upwardly through said pole past said opening, said conduit being rotatable within said pole;

a sprinkler being mounted atop said pole and being connected to said conduit;

a reel being affixed to said conduit within said pole adjacent said opening, said reel being rotatable with said conduit;

a net, capable of extension from said opening in said pole, being wound upon said reel;

an elongated cover for closing said opening in said pole, said cover being connected to said net for supporting said net above the earth when said net is extended from said opening in said pole; and, a handgrip, for rotating said conduit to rewind said net upon said reel, being affixed to said conduit.

2. The game system according to claim 1 further comprising:

a tether being affixed at its top to the top of said pole; and, a tetherball affixed to the bottom of said tether.

* * * * *